US006440208B1

(12) United States Patent
Christie et al.

(10) Patent No.: US 6,440,208 B1
(45) Date of Patent: Aug. 27, 2002

(54) ALLOY COLOR EFFECT MATERIALS AND PRODUCTION THEREOF

(75) Inventors: James D. Christie, Yonkers; Daniel S. Fuller, Beacon; Curtis J. Zimmermann, Cold Spring, all of NY (US)

(73) Assignee: Engelhard Corporation, NJ (US)

( * ) Notice: Subject to any disclaimer, the term of this patent is extended or adjusted under 35 U.S.C. 154(b) by 53 days.

(21) Appl. No.: 09/707,229

(22) Filed: Nov. 6, 2000

(51) Int. Cl.[7] ..... C09C 1/00; C09C 1/04; C09C 1/24; C09C 1/28; C09C 1/66

(52) U.S. Cl. ..... 106/415; 106/403; 106/404; 106/417; 106/419; 106/431; 106/440; 106/461; 106/480; 106/481; 106/482

(58) Field of Search ..... 106/403, 404, 106/415, 417, 419, 431, 440, 461, 480, 481, 482

(56) References Cited

U.S. PATENT DOCUMENTS

| | | | | |
|---|---|---|---|---|
| 3,438,796 | A | 4/1969 | Hanke | 106/291 |
| 4,434,010 | A | 2/1984 | Ash | 106/291 |
| 5,030,445 | A | 7/1991 | Hashimoto et al. | 424/59 |
| 5,059,245 | A | 10/1991 | Phillips et al. | 106/22 |
| 5,135,812 | A | 8/1992 | Phillips et al. | 428/403 |
| 5,171,363 | A | 12/1992 | Phillips et al. | 106/22 |
| 5,279,657 | A | 1/1994 | Phillips et al. | 106/22 |
| 5,281,480 | A | 1/1994 | Phillips et al. | 428/412 |
| 5,624,486 | A | 4/1997 | Schmid et al. | 106/404 |
| 5,648,165 | A | 7/1997 | Phillips et al. | 428/346 |
| 5,766,335 | A | 6/1998 | Bujard et al. | 106/404 |
| 5,766,738 | A | 6/1998 | Phillips et al. | 428/200 |
| 5,958,125 | A | 9/1999 | Schmid et al. | 106/417 |
| 6,013,370 | A | 1/2000 | Coutler et al. | 428/403 |
| 6,136,083 | A | 10/2000 | Schmidt et al. | 106/403 |
| 6,150,022 | A | 11/2000 | Coutler et al. | 428/403 |
| 6,157,489 | A | 12/2000 | Bradley, Jr. et al. | 359/584 |
| 6,267,810 | B1 * | 7/2001 | Pfaff et al. | 106/404 |
| 6,325,847 | B1 * | 12/2001 | Christie et al. | 106/403 |

FOREIGN PATENT DOCUMENTS

| | | |
|---|---|---|
| WO | 0313281 | 4/1989 |

OTHER PUBLICATIONS

International Search Report (in English) issued Mar. 8, 2001 in a related application.

* cited by examiner

*Primary Examiner*—Elizabeth D. Wood
(74) *Attorney, Agent, or Firm*—Dickstein, Shapiro, Morin & Oshinsky LLP

(57) ABSTRACT

A color effect material is composed of a plurality of encapsulated substrate platelets in which each platelet is encapsulated with copper, zinc, an alloy of copper, or an alloy of zinc first layer which acts as a reflector to light directed thereon, a second layer encapsulating the first layer in which the second layer provides an optically variable reflection of light impinging thereon and a third layer encapsulating the second layer and being selectively transparent to light directed thereon.

25 Claims, No Drawings

ALLOY COLOR EFFECT MATERIALS AND PRODUCTION THEREOF

BACKGROUND OF THE INVENTION

Optically variable pigments have been described in the patent literature since the 1960s. Hanke in U.S. Pat. No. 3,438,796 describes the pigment as being "thin, adherent, translucent, light transmitting films or layers of metallic aluminum, each separated by a thin, translucent film of silica, which are successively deposited under controlled conditions in controlled, selective thicknesses on central aluminum film or substrate". These materials are recognized as providing unique color travel and optical color effects.

The prior art approaches to optically variable pigments have generally adopted one of two techniques. In the first, a stack of layers is provided on a temporary substrate which is often a flexible web. The layers are generally made up of aluminum and $MgF_2$. The stack of film is separated from the substrate and subdivided through powder processing into appropriately dimensioned particles. The pigments are produced by physical techniques such as physical vapor deposition onto the substrate, separation from the substrate and subsequent comminution. In the pigments obtained in this way, the central layer and all other layers in the stack are not completely enclosed by the other layers. The layered structure is visible at the faces formed by the process of comminution.

In the other approach, a platelet shaped opaque metallic substrate is coated or encapsulated with successive layers of selectively absorbing metal oxides and non-selectively absorbing layers of carbon, metal and/or metal oxide. To obtain satisfactory materials using this approach, the layers are typically applied by chemical vapor deposition techniques in a fluidized bed. A major shortcoming of this technique is that fluidized bed processes are cumbersome and require substantial technical infrastructure for production. An additional limitation related to the substrates utilized is that traditional metal flakes usually have structural integrity problems, hydrogen outgassing problems and other pyrophoric concerns.

The prior art approaches suffer from additional disadvantages. For instance, certain metals or metal flake such as chromium and aluminum, specifically when they are used as outer layers may have perceived health and environmental impacts associated with their use. The minimization of their use in optical effect materials should be advantageous due to their perceived impact.

SUMMARY OF THE INVENTION

The present invention provides a color effect material comprising a platelet-shaped substrate encapsulated with (a) a first layer selected from the group consisting of copper, zinc, an alloy of copper, and an alloy of zinc, wherein said first layer is highly reflective to light directed thereon; and (b) a second layer encapsulating the first layer and providing a variable pathlength for light dependent on the angle of incidence of light impinging thereon in accordance with Snell's Law; and (c) a selectively transparent third layer to light directed thereon.

DESCRIPTION OF THE INVENTION

It is an object of the present invention to provide novel color effect materials (CEMs) which can also be prepared in a reliable, reproducible and technically efficient manner. This object is achieved by a CEM comprising a platelet-shaped substrate coated with: (a) a first layer of copper, zinc, an alloy of copper, or an alloy of zinc which is highly reflective to light directed thereon; and (b) a second layer encapsulating the first layer in which the second layer consists of a low index of refraction material, typically a refractive index from 1.3 to 2.5 and more specifically between 1.4 and 2.0, that provides a variable path length for light dependent on the angle of incidence of light impinging thereon; and (c) a selectively transparent third layer to light directed thereon.

The degree of reflectivity for the first encapsulating layer should be from 100% to 5% reflectivity, whereas the selective transparency of the third encapsulating layer should be from 5% to 95% transmission. More specifically, one would prefer to have 50–100% reflectivity and 50–95% transparency for the first and third encapsulating layers, respectively. The degree of reflectivity and transparency for different layers can be determined by a variety of methods such as ASTM method E1347-97, E1348-90 (1996) or F1252-89 (1996).

The substrate can be mica, aluminum oxide, bismuth oxychloride, boron nitride, glass flake, iron oxide-coated mica (ICM), silicon dioxide, titanium dioxide-coated mica (TCM), copper flake, zinc flake, alloy of copper flake, alloy of zinc flake, or any encapsulatable smooth platelet. The first layer encapsulating the substrate can be copper, zinc, an alloy of copper or an alloy of zinc. Of course, when the substrate is copper flake, zinc flake, alloy of copper flake or alloy of zinc flake, there is no need for such a first layer since it would be part of the substrate. The second encapsulating layer can be silicon dioxide or magnesium fluoride. The third encapsulating layer can be a precious metal, i.e., silver, gold, platinum, palladium, rhodium, ruthenium, osmium and/or iridium or alloys thereof. Alternatively, the third layer can be copper, silicon, titanium dioxide, iron oxide, chromium oxide, a mixed metal oxide, aluminum, and zinc.

An advantage of the present invention is that one does not have to start with a traditional metal flake which may have structural integrity problems, hydrogen outgassing problems and a host of other perceived issues (pyrophoric and environmental concerns) typically associated with metal flakes. The brass alloy used in this invention is much more chemically stable than aluminum and is known to have long term weatherability stability. Brass is nearly chemically inert which allows great flexibility in the chemical systems employed in the manufacture of such effect materials and in their applications in end uses such as in paint and polymer systems. Another advantage over the prior art is that brass, as one of the reflecting layers used in this invention, is a good reflector of white light and at the same time provides an attractive bulk color. The same would be true for an aluminum-copper alloy. Such an alloy is advantageous due to its attractive bulk color effect, while maintaining high reflectivity. Additionally, both brass and copper coated substrates provide the decorative/functional attributes of brass and copper, however under more environmentally favorable terms due to the reduced metal concentration since the CEM's of the present invention are not pure brass or copper, rather brass or copper coated inorganic substrates. In addition, one can produce the CEM's where the outer encapsulating layers are not made of brass. Another advantage over the prior art is that silver, or other metals such as gold, platinum, palladium, rhodium, ruthenium, osmium and iridium, as the final (outer) encapsulating layer of the effect material will impart electrical conductivity to the pigment which may be desirable in some applications such as powder coatings.

A surprising aspect of the present invention is that cost effective composite materials are created with desirable optical effect properties.

Metal layers are preferably deposited by electroless deposition and the non-metal layers preferably by sol-gel deposition. An advantage of electroless deposition (Egypt. J. Anal. Chem., Vol. 3, 118–123 (1994)) is that it is a world wide established chemical technique, not requiring cumbersome and expensive infrastructure compared to other techniques. The electroless deposition technique also allows one to control the degree of reflectivity of light quite accurately and easily by varying the metal film thickness. Additionally, the known procedures are generalized procedures capable of being utilized for coating a variety of surfaces. Furthermore, an encapsulating layer of a metal or metal oxide can also be deposited onto any of the substrates by chemical vapor deposition from an appropriate precursor (The Chemistry of Metal CVD, edited by Toivo T. Kodas and Mark J. Hampden-Smith; VCH Verlagsgesellschaft mbH, D-69451 Weinheim, 1994, ISBN 3-527-29071-0).

For deposition of alloys, a unique method has been developed as described in U.S. Pat. No. 4,940,523 which outlines a "process and apparatus for coating fine particles." In addition, the technique can be used to deposit pure metals such as chromium, platinum, gold and aluminum, or ceramics.

The products of the present invention are useful in automotive, cosmetic, industrial or any other application where metal flake or pearlescent pigments are traditionally used.

The size of the platelet-shaped substrate is not critical per se and can be adapted to the particular use. In general, the particles have average largest major dimensions of about 5–250 $\mu$m, in particular 5–100 $\mu$m. Their specific free surface area (BET) is in general from 0.2 to 25 $m^2/g$.

The CEMs of the invention are notable for multiple encapsulation of the platelet-shaped substrate.

The first metallic encapsulating layer is highly reflective to light directed thereon. The thickness of the first layer is not critical so long as it is sufficient to make the layer highly reflective. If desirable, the thickness of the first layer can be varied to allow for selective transmission of light. The thickness of the first metallic layer may be 5 nm to 500 nm and preferably 25 nm to 100 nm for copper, zinc or alloys thereof. A metallic layer thickness out of the above mentioned ranges will typically be either completely opaque or allow for substantial transmission of light. In addition to its reflective properties, the metallic encapsulating layer may exhibit unique bulk color effects depending on the film thickness. For example, a brass coating thickness of >50 nm will begin to exhibit a metallic gold bulk color, while maintaining good reflectivity. The mass percent of the coating will be directly related to the surface area of the particular substrate being utilized.

The second encapsulating layer must provide a variable pathlength for light dependent on the angle of incidence of light impinging thereon and therefore, any low index of refraction material that is visibly transparent may be utilized. Preferably, the second layer is selected from the group consisting of silicon dioxide ($SiO_2$), suboxides of silicon dioxide ($SiO_{0.25}$ to $SiO_{1.95}$) or magnesium fluoride.

The thickness of the second layer varies depending on the degree of color travel desired. In addition, the second layer will have a variable thickness depending on a variety of factors, especially refractive index. Materials having a refractive index around 1.5 tend to require a film thickness of a few hundred nanometers for generation of unique color travel. For instance, a second layer has a preferable thickness of about 75 to 500 nm for silicon dioxide and for magnesium fluoride.

In one embodiment, the second layer is encapsulated by a selectively-transparent third layer that allows for partial reflection of light directed thereon. Preferably, the third encapsulating layer is selected from the group consisting of copper, silicon, titanium dioxide, iron oxide, chromium oxide, a mixed metal oxide, aluminum or alloys thereof. More preferably, the third encapsulating layer is one or more of the precious metals selected from the group consisting of silver, gold, platinum, palladium, rhodium, ruthenium, osmium and/or iridium or alloys thereof.

Of course, the third layer can also contribute to the interference color of the pigment. Its thickness can vary but must always allow for partial transparency. For instance, a third layer has a preferable thickness of about 5 to 20 nm for silicon; about 2 to 15 nm for aluminum; about 2–10 nm for copper; about 2–10 nm for zinc; about 1–15 nm for titanium nitride; about 10 to 60 nm for iron oxide; about 10 to 60 nm for chromium oxide; about 10–100 nm for titanium dioxide; about 5 to 60 nm for a mixed metal oxide, about 5 to 20 nm for silver; about 3 to 20 nm for gold; about 3–20 nm for platinum; and about 5 to 20 nm for palladium. The precious metal and base metal alloys generally have a similar film thickness requirement compared to the pure metal. It is recognized that a film thickness out of the above range may be applicable depending on the desired effect.

All the encapsulating layers of the CEM of the invention are altogether notable for a uniform, homogeneous, film-like structure that results from the manner of preparation according to the invention.

In the novel process for preparing the coated platelet-like substrates, the individual coating steps are each effected by sputter deposition, electroless deposition or hydrolysis/condensation of suitable starting compounds in the presence of the substrate particles to be coated. Alloys, such as brass, can be deposited by a sputtering technique as described in U.S. Pat. No. 4,940,523. In addition, pure metals such as aluminum, copper and zinc, as well as others, can be sputter deposited. For instance, metals can be deposited from reduction of aqueous salts of the metals, such as $HAuCl_4$, $AgNO_3$, $CuSO_4$, $H_2PtCl_6$, $PdCl_2$. Silicon dioxide can be deposited from a compound selected from the group consisting of silicon tetraalkoxides such as tetraethoxysilane, bases such as sodium silicate and halide silanes such as silicon tetrachloride; titanium dioxide from tetraalkoxides such as titanium tetraethoxide, halide compounds such as titanium tetrachloride and sulfate compounds such as titanium sulfate, titanium nitride from titanium tetrachloride, tetrakis (diethylamido)titanium (TDEAT) and tetrakis (dimethylamido)titanium (TDMAT); iron oxide from iron carbonyl, iron sulfate and iron chloride; and chromium oxide from chromium carbonyl and chromium chloride.

In general, the synthesis of an alloy color effect material can be as follows: a platelet material such as glass flake is placed in an evacuated rotary cylinder as described in U.S. Pat. No. 4,940,523. A sputtering target of brass is utilized to coat the particulate material with a highly reflective coating. The highly reflective alloy coated substrate is removed from the evacuated cylinder and re-suspended in an alcoholic solvent such as butanol for deposition of the encapsulating silicon dioxide layer. A Stöber process can be employed for the deposition of silicon dioxide on the metal coated mica or other substrate (C. Jeffery Brinker and George W. Schera, Sol-Gel Science, The Physics and Chemistry of Sol-Gel Processing, Academic Press, Inc. (1990)). An alcoholic azeotropic mixture, such as ethanol and water, may be used in place of pure alcohol for the Stöber process. The silica encapsulated metal coated platelet is filtered, washed and resuspended in a stirred aqueous medium. To the aqueous medium is added a silver precursor capable of depositing silver on the substrate by electroless deposition, along with a suitable reducing agent. The metal solution for electroless deposition is added as described above allowing for the deposition of a selectively transparent metal coating. The final particulate product is washed, dried and exhibits optical color effects as a function of viewing angle.

Depending on the thickness of the low refractive index second encapsulating layer, the final CEM will display multiple different color effects as a function of viewing angle (red, orange, green, violet). The platelet substrate acts as a carrier substrate. It may, or may not, have a contribution or effect on the final optical properties of the particulate.

The color effect materials (CEMs) of the invention are advantageous for many purposes, such as the coloring of paints, printing inks, plastics, glasses, ceramic products and decorative cosmetic preparations. Their special functional properties make them suitable for many other purposes. The CEMs, for example, could be used in electrically conductive or electromagnetically screening plastics, paints or coatings or in conductive polymers. The conductive functionality of the CEMs makes them of great utility for powder coating applications.

The above mentioned compositions in which the compositions of this invention are useful are well known to those of ordinary skill in the art. Examples include printing inks, nail enamels, lacquers, thermoplastic and thermosetting materials, natural resins and synthetic resins, polystyrene and its mixed polymers, polyolefins, in particular polyethylene and polypropylene, polyacrylic compounds, polyvinyl compounds, for example polyvinyl chloride and polyvinyl acetate, polyesters and rubber, and also filaments made of viscose and cellulose ethers, cellulose esters, polyamides, polyurethanes, polyesters, for example polyglycol terephthalates, and polyacrylonitrile.

Due to its good heat resistance, the pigment is particularly suitable for the pigmenting of plastics in the mass, such as, for example, of polystyrene and its mixed polymers, polyolefins, in particular polyethylene and polypropylene and the corresponding mixed polymers, polyvinyl chloride and polyesters in particular polyethylene glycol terephthalate and polybutylene terephthalate and the corresponding mixed condensation products based on polyesters.

For a well rounded introduction to a variety of pigment applications, see Temple C. Patton, editor, The Pigment Handbook, volume II, Applications and Markets, John Wiley and Sons, New York (1973). In addition, see for example, with regard to ink: R. H. Leach, editor, The Printing Ink Manual, Fourth Edition, Van Nostrand Reinhold (International) Co. Ltd., London (1988), particularly pages 282–591; with regard to paints: C. H. Hare, Protective Coatings, Technology Publishing Co., Pittsburg (1994), particularly pages 63–288. The foregoing references are hereby incorporated by reference herein for their teachings of ink, cosmetic, paint and plastic compositions, formulations and vehicles in which the compositions of this invention may be used including amounts of colorants. For example, the pigment may be used at a level of 10 to 15% in an offset lithographic ink, with the remainder being a vehicle containing gelled and ungelled hydrocarbon resins, alkyd resins, wax compounds and aliphatic solvent. The pigment may also be used, for example, at a level of 1 to 10% in an automotive paint formulation along with other pigments which may include titanium dioxide, acrylic latices, coalescing agents, water or solvents. The pigment may also be used, for example, at a level of 20 to 30% in a plastic color concentrate in polyethylene.

EXAMPLE 1

Procedure for Evaluation of CEMs According to the Invention

The luster and color are evaluated using drawdowns on a hiding chart (Form 2–6 Opacity Charts of the Leneta Company) both visually and instrumentally. A drawdown on the black portion of the card displays the reflection color while the white portion displays the transmission color at non-specular angles.

The drawdowns are prepared by incorporating 3–12% CEM in a nitrocellulose lacquer, with the concentration dependent on the particle size distribution of the CEM. For example, a 3% drawdown would likely be used for an average CEM particle size of 20 $\mu$m while a 12% drawdown might be used for an average CEM particle size of 100 $\mu$m. The CEM-nitrocellulose suspension is applied to the drawdown card using a Bird film application bar with a wet film thickness of 3 mil.

When these drawdowns are observed visually, a variety of colors can be observed dependent on the viewing angle, such as, aqua to blue to violet. The degree of color travel observed is controlled by the thickness of the low index of refraction layer. Other quantifiable parameters commonly used to describe effect pigments, such as lightness (L*) and chromaticity (C*), can be controlled through both: a) the choice of materials used as lower reflecting and top, selectively transmitting layers and b) the thickness of said lower and top layers.

The drawdowns were further characterized using a goniospectrophotometer (CMS-1500 from Hunter). The reflectivity vs. wavelength curves were obtained at various viewing angles. The color travel for the CEM was described using the CIELab L*a*b* system. The data is recorded both numerically and graphically. The numerical recording for three CEM's representative of that obtained in Example 3 is as follows:

TABLE 1

| Sample | Incident Angle | Viewing Angle | L* | a* | b* |
|---|---|---|---|---|---|
| 8% $SiO_2$ | 10 | 0 | 192.23 | −6.66 | 16.472 |
| 8% $SiO_2$ | 20 | 0 | 208.61 | −6.93 | 10.98 |
| 8% $SiO_2$ | 30 | 0 | 214.46 | −7.56 | 7.256 |
| 8% $SiO_2$ | 40 | 0 | 222.89 | −5.52 | 1.496 |
| 8% $SiO_2$ | 50 | 0 | 234.26 | 0.61 | 3.06 |
| 8% $SiO_2$ | 60 | 0 | 232.6 | 29.32 | 20.576 |
| 11% $SiO_2$ | 10 | 0 | 164.67 | 3.72 | 3.836 |
| 11% $SiO_2$ | 20 | 0 | 182.51 | 4.53 | 3.716 |
| 11% $SiO_2$ | 30 | 0 | 193.37 | 5.79 | 5.952 |
| 11% $SiO_2$ | 40 | 0 | 203.19 | 7.25 | 8.328 |
| 11% $SiO_2$ | 50 | 0 | 217.76 | 7.53 | 7.436 |
| 11% $SiO_2$ | 60 | 0 | 227.82 | 20.51 | 16.404 |
| 13% $SiO_2$ | 10 | 0 | 165.19 | 3.87 | 19.432 |
| 13% $SiO_2$ | 20 | 0 | 184.76 | 1.76 | 14.456 |
| 13% $SiO_2$ | 30 | 0 | 190.71 | −0.27 | 11.848 |
| 13% $SiO_2$ | 40 | 0 | 198.05 | −1.52 | 6.644 |

TABLE 1-continued

| Sample | Incident Angle | Viewing Angle | L* | a* | b* |
|---|---|---|---|---|---|
| 13% $SiO_2$ | 50 | 0 | 214.33 | −1.54 | 0.524 |
| 13% $SiO_2$ | 60 | 0 | 221.76 | 6.7 | 7.556 |

Above samples are:
8% $SiO_2$
11% $SiO_2$
13% $SiO_2$

The L*a*b* data characterizes the appearance of the sample. L* is the lightness/darkness component, a* describes the red/green color component, b* represents the blue/yellow component.

EXAMPLE 2

Preparation of Cu/$SiO_2$/Cu CEM

Copper is deposited according to well established electroless deposition techniques as demonstrated in the following example.

Two hundred grams of glass flakes (100 micron average major dimension) and 500 ml of distilled water are placed into a 3 L Morton flask equipped with a mechanical stirring apparatus to form a slurry. The slurry is stirred at room temperature.

To the slurry is rapidly added a solution which is prepared as follows: 11.0 grams of maleic acid, 16.0 grams of sodium hydroxide pellets, 80.0 grams of triethanolamine, 36.0 grams of copper sulfate pentahydrate, 8.0 ml of dimethyl sulfoxide are dissolved into 800 ml of distilled water in a 1 L beaker equipped with a magnetic stirrer. These ingredients are stirred at room temperature until a homogeneous solution is achieved.

The slurry is then heated to 45° C. Twelve grams of 35% hydrazine solution are added to the flask and the slurry is stirred for 90 minutes at 45° C. and then filtered. The resulting product is rinsed with 500 ml of distilled water and then with 500 ml of isopropanol.

One hundred grams of the wet product (75 grams of dry weight) is transferred into a 2 L Morton flask equipped with a mechanical stirring apparatus. Nine hundred ml of isopropanol, 5.3 grams of 29% ammonium hydroxide solution, 112 grams of distilled water and 112 grams of tetraethoxysilane are added to the flask. The slurry is stirred for 7 hours at room temperature and then filtered, and the product washed and oven dried.

10 grams of this silica-coated material is added to a 50 ml. Beaker containing a solution of 0.20 grams of maleic acid, 0.30 grams of NaOH pellets, 1.49 grams of triethanolamine, 0.67 grams of copper sulfate pentahydrate, 0.15 grams of dimethyl sulfoxide and 20 mls. of distilled water. The slurry is stirred magnetically and heated to 45° C. 0.25 grams of a 35% hydrazine solution is added to the slurry. Almost instantly, an intense violet color appears in the slurry. The slurry is then stirred at 45° C. for 30 minutes, then the product is filtered and washed with distilled water before drying at 120°0 C. The product displays a clean color flop from violet to bulk copper color upon a change in viewing angle of a lacquer film containing the product.

EXAMPLE 3

Preparation of Brass/$SiO_2$/Ag CEM

Seventy five grams of a Cu—Zn (brass) coated glass flake sample are slurried into 110 ml of isopropanol in a 3-necked round bottom flask. The slurry is then mechanically stirred vigorously. To the slurry 2.6 ml of 29% $NH_4$0H and 31 ml of distilled water are added. The slurry is heated to a 60° C. set point. A solution of 25.0 grams of tetraethoxysilane in 25 ml of isopropanol is added to the slurry over a 6 hour period. The slurry is stirred for 16 hours beyond the addition at the set temperature. The slurry is then cooled to room temperature, filtered on a filter cloth, rinsed with isopropanol, and dried at 120° C.

Five grams of this silica coated material is slurried in 50 ml of water. A colloidal solution of 0.10 grams of $SnCl_2.2H_2O$ in 50 ml of water is added to the slurry. The slurry is stirred for 10 minutes and filtered and the product washed free of solutes. The presscake is then reslurried into 50 grams of a 0.2% dextrose solution. A solution of 0.08 grams of $AgNO_3$, 45 grams of water and a slight excess of 2-amino-2-methyl-1-propanol is quickly added to the slurry. Within 1 minute of stirring, the slurry produced a green interference color. After 15 minutes of stirring, the supernatant liquid is tested for silver ion by the addition of a few drops of concentrated hydrochloric acid. The test is a visual assessment of any precipitate and/or turbidity of which none is found. The slurry was filtered and the product washed and dried at 120° C. The particulate color effect material product displayed a color flop from green to blue upon a change in viewing angle when dispersed in a nitrocellulose lacquer film and applied to a black and white draw down card. When smeared on the skin, the same particulate effect materials exhibited similar color travel (color shifts) compared to the draw down card.

The above procedure is reproduced with varying concentrations of tetraethoxysilane. Three samples are produced having approximately 8.0, 11.0 and 13.0 percent silicon dioxide. The numerical data for these samples is shown in Example 1.

EXAMPLE 4

Preparation of a Zn/$SiO_2$/Ag CEM

A 50 gram sample of zinc flake (K-308 from Transmet Corporation) mixed with 80.0 ml of isopropyl alcohol is placed in a 250 ml 3-necked round bottom flask equipped with a heating mantle, reflux condenser, temperature probe and teflon agitator paddle. To the flask is added 1.0 ml of 29% ammonium hydroxide solution and 2.0 ml of distilled water. The slurry is heated to 60° C. and vigorously stirred. After heating and stirring for 20 minutes, 0.8 grams of tetraethoxysilane (TEOS) is added to the slurry and allowed to stir at temperature for an additional 20 hours. An additional 3.0 grams of TEOS, 3.0 ml of distilled water and 1.0 ml 29% ammonium hydroxide is added to the suspension and allowed to stir at temperature for an additional 23 hours. The suspension is then filtered, washed with isopropyl alcohol and dried at 120° C. From the dried powder, 10 grams of sample is mixed with 50.0 ml of distilled water in a 3-necked round bottom flask as described above. A solution of 0.20 grams of $SnCl_2.2H_2O$ in 50 ml of distilled water is added to the flask containing the suspension and stirred for 20 minutes followed by filtration and rinsing. The wet presscake is then placed back in a 250 ml round bottom flask containing a solution of 0.10 grams of dextrose in 50 ml of distilled water at 21° C. and vigorous stirring. An additional solution consisting of 0.08 grams of silver nitrate, 45 ml of distilled water and a slight excess of 50% 2-amino-2-methyl-1-propanol is added to the flask. After an additional 25 minutes of stirring, the suspension is filtered washed and dried.

EXAMPLE 5

Preparation of a Al—Cu/$SiO_2$/Ag CEM

The procedure similar to example 4 was repeated utilizing a 50 gram sample of aluminum-copper alloy flake (K-3402 from Transmet Corporation).

EXAMPLE 6

An alloy CEM prepared according to Example 3 is incorporated into polypropylene step chips at 1% concentration. The step chips are appropriately named since they have graduating thickness at each step across the face of the chip. The graduating steps allow one to examine the different effect of the alloy CEM based on polymer thickness.

EXAMPLE 7

An alloy CEM prepared according to Example 3 is incorporated into a nail enamel. 10 g of alloy CEM is mixed with 82 g of suspending lacquer SLF-2, 4 g lacquer 127P and 4 g ethyl acetate. The suspending lacquer SLF-2, 4 g lacquer 127P and 4 g ethyl acetate. The suspending lacquer SLF-2 is a generic nail enamel consisting of butyl acetate, toluene, nitrocellulose, tosylamide/formaldehyde resin, isopropyl alcohol, dibutyl phthalate, ethyl acetate, camphor, n-butyl alcohol and silica.

EXAMPLE 8

A 10% by weight alloy CEM prepared according to Example 3 is sprayed in a polyester TGIC powder coating from Tiger Drylac using a PGI corona Gun #110347.

1. The alloy CEM is mixed in a clear polyester system and sprayed over a RAL 9005 black powder sprayed base.
2. The alloy CEM is mixed into a RAL 9005 black pigmented polyester powder. The color effect material is highly attracted to the ground metal panel due to its electrical properties. Additionally, due to its high affinity to orient closely to the surface that resulted in a finish that has a high distinctness of image (DOI) it does not require an additional clear coat to reduce protrusion often caused by traditional pearlescent and metal flake pigments.

EXAMPLE 9

A 10% dispersion of the alloy CEM prepared according to Example 3 is mixed into a clear acrylic urethane basecoat clearcoat paint system DBX-689 (PPG) along with various PPG tints to achieve desired color. The tink pastes consist of organic or inorganic colorants dispersed at various concentrations in a solventborne system suitable with the DMD Deltron Automotive Refinish paint line from PPG. The complete formulation is sprayed using a conventional siphon feed spraygun onto 4×12" curved automotive type panels supplied by Graphic Metals. The panel is clear coated with PPG 2001 high solids polyurethane clear coat and air dried.

Various changes and modifications can be made in the process and products of the invention without departing from the spirit and scope thereof. The various embodiments disclosed herein were for the purpose of illustration only and were not intended to limit the invention.

What is claimed is:

1. A color effect material comprising a platelet-shaped substrate encapsulated with:

(a) a first layer selected from the group consisting of copper, zinc, an alloy of copper, and an alloy of zinc, wherein said layer is highly reflective to light directed thereon; and (b) a second layer encapsulating the first layer and providing a variable pathlength for light dependent on the angle of incidence of light impinging thereon; and (c) a third layer selectively transparent to light directed thereon.

2. The color effect material of claim 1, wherein the substrate is selected from the group consisting of mica, aluminum oxide, bismuth oxychloride, boron nitride, glass flake, iron oxide-coated mica, iron oxide coated glass, silicon dioxide, titanium dioxide coated mica, titanium dioxide coated glass, copper flakes, zinc flakes, alloy of copper flakes, and alloy of zinc flakes.

3. The color effect material of claim 1, wherein the first layer is an alloy of copper and zinc.

4. The color effect material of claim 1, wherein the first layer is an alloy of aluminum and copper.

5. The color effect material of claim 1, wherein the first layer is an alloy of aluminum and zinc.

6. The color effect material of claim 1, wherein the first layer is copper.

7. The color effect material of claim 1, wherein the first layer is zinc.

8. The color effect material of claim 1, wherein the second encapsulating layer is selected from the group consisting of silicon dioxide and magnesium fluoride.

9. The color effect material of claim 8, wherein the second encapsulating layer is silicon dioxide.

10. The color effect material of claim 1, wherein the third encapsulating layer is selected from the group consisting of silver, gold, platinum, palladium, rhodium, ruthenium, osmium, iridium, and alloys thereof.

11. The color effect material of claim 10, wherein the third encapsulating layer is silver.

12. The color effect material of claim 10, wherein the third encapsulating layer is gold.

13. The color effect material of claim 10, wherein the third encapsulating layer is platinum.

14. The color effect material of claim 10, wherein the third encapsulating layer is palladium.

15. The color effect material of claim 10, wherein the third encapsulating layer is copper.

16. The color effect material of claim 10, wherein the first encapsulating layer is said alloy.

17. The color effect material of claim 1, wherein the third layer is selected from the group consisting of copper, silicon, titanium dioxide, iron oxide, chromium oxide, a mixed metal oxide, aluminum, and alloys thereof.

18. The color effect material of claim 1, wherein the first layer is a sputter deposited layer.

19. The color effect material of claim 1, wherein the first layer is an electroless deposition layer.

20. The color effect material of claim 1, wherein the second layer is a sol-gel deposition layer.

21. The color effect material of claim 1, wherein the substrate is platelet-shaped glass flake, the highly reflective first encapsulating layer is an alloy of copper and zinc, the second encapsulating layer is silicon dioxide and the third encapsulating layer is a selectively transparent layer of silver.

22. The color effect material of claim 2, wherein the substrate is platelet-shaped glass flake, the highly reflective first encapsulating layer is an alloy of copper and zinc, the second encapsulating layer is silicon dioxide and the third encapsulating layer is a selectively transparent layer of copper.

23. A method of making a precious metal color effect material comprising:

(a) coating a platelet-shaped substrate with a first layer selected from the group consisting of copper, zinc, an alloy of copper, and an alloy of zinc, wherein said first layer is highly reflective to light directed thereon;

(b) encapsulating the first layer with a second layer providing a variable pathlength for light dependent on the angle of incidence of light impinging thereon; and (c) encapsulating the second layer with a third layer selectively transparent to light directed thereon.

24. The method of claim 23, wherein the substrate is selected from the group consisting of mica, aluminum oxide, bismuth oxychloride, boron nitride, glass flake, iron oxide-coated mica, iron oxide coated glass, silicon dioxide, titanium dioxide coated mica, titanium dioxide coated glass, copper flakes, zinc flakes, alloy of copper flakes, and alloy of zinc flakes.

25. The method of claim 23, wherein the second layer is selected from the group consisting of silicon dioxide and magnesium fluoride, and wherein the third layer is selected from the group consisting of copper silver, gold, platinum, palladium, silicon, iron oxide, chromium oxide, a mixed metal oxide, aluminum, and alloys thereof.

* * * * *